US005996910A

United States Patent [19]

Takeda et al.

[11] Patent Number: 5,996,910

[45] Date of Patent: Dec. 7, 1999

[54] FUEL INJECTION VALVE AND METHOD OF MANUFACTURING THE SAME

[75] Inventors: Hideto Takeda, Kariya; Satoshi Sugiyama, Toyohashi; Haruo Suzuki, Nishikasugai-gun; Masaki Funahashi, Handa; Yoshihiro Tanimura, Kariya; Eiji Iwanari, Chiryu, all of Japan

[73] Assignee: Denso Corporation, Japan

[21] Appl. No.: 08/964,220

[22] Filed: Nov. 4, 1997

[30] Foreign Application Priority Data

| | | | |
|---|---|---|---|
| Nov. 13, 1996 | [JP] | Japan | 8-301450 |
| Aug. 28, 1997 | [JP] | Japan | 9-232039 |
| Oct. 9, 1997 | [JP] | Japan | 9-277528 |

[51] Int. Cl.[6] ..... B05B 1/30; F02M 51/00

[52] U.S. Cl. ..... 239/585.1; 239/600; 239/DIG. 19; 251/129.21; 29/888.4; 29/890.143

[58] Field of Search ..... 239/585.1–585.5, 239/600, DIG. 19; 251/129.15, 129.16, 129.21; 29/888.4, 890.143

[56] References Cited

FOREIGN PATENT DOCUMENTS

| | | |
|---|---|---|
| 629711A1 | 6/1994 | European Pat. Off. . |
| 5-288130 | 11/1993 | Japan . |
| 2262659A | 11/1992 | United Kingdom . |

*Primary Examiner*—Andres Kashnikow
*Assistant Examiner*—Steven J. Ganey
*Attorney, Agent, or Firm*—Nixon & Vanderhye P.C.

[57] ABSTRACT

A fuel injection valve has a single pipe member made of composite magnetic material which can be processed to form ferro-magnetic structures and non-magnetic structures. A magnetic fuel connector, a magnetic valve body, a non-magnetic intermediate pipe are formed in the single pipe member. An electromagnetic solenoid is disposed around the intermediate pipe, and a needle valve is disposed in the valve body. A magnetic stationary core is disposed inside the fuel connector, and a magnetic movable core is disposed inside the valve body in a magnetic circuit composed of the solenoid, the fuel connector, the stationary core and the valve body.

12 Claims, 9 Drawing Sheets

FUEL INJECTION VALVE AND METHOD OF MANUFACTURING THE SAME

CROSS REFERENCE TO RELATED APPLICATION

The present application is based on and claims priority from Japanese Patent Applications Hei 8-301450 filed on Nov. 13, 1996, Hei 9-232039 filed on Aug. 28, 1997 and Hei 9-277528, filed on Oct. 9, 1997, the contents of which are incorporated herein by reference.

BACKGROUND OF THE INVENTION

1. Field of the Invention

The present invention relates to a fuel injection valve and a method of manufacturing the same.

2. Description of the Related Art

JP-A-5-288130 discloses a fuel injection valve which is composed of a unit member made of magnetic material having a fuel connector and a cylindrical core, an intermediate pipe soldered or welded to the bottom of the core and a valve body soldered or welded to the bottom of the intermediate pipe.

In order to introduce high pressure fuel inside the fuel connector, the cylindrical core and tile valve body, the soldering or welding is indispensable in the above structure.

However, when the fuel connector and the intermediate pipe are soldered or welded, they may be out of alignment due to high temperature of the soldering or welding. This may cause inaccurate fuel injection.

SUMMARY OF THE INVENTION

Therefore, a main object of the present invention is to provide an improved injection valve which can be manufactured using fewer steps at a lower production cost. The improved injection valve can inject fuel more accurately.

According to a main feature of the present invention, a fuel injection valve has a single pipe member made of composite magnetic material a magnetic fuel connector, a non-magnetic intermediate pipe and a magnetic valve body are formed integrally in the single pipe.

A magnetic stationary core may be integrated into the pipe member. In this case, a non-magnetized structure is formed to divide the magnetic structure, thereby providing a solid gap. The valve seat may be formed integrally with the valve body.

According to another feature of the present invention, the fuel connector has an inner diameter which is equal to or larger than an inner diameter of the intermediate pipe. Therefore, the needle valve, the movable core, the stationary core, etc. can be inserted into the pipe one after another, and the manufacturing steps are very simple.

According to another feature of the present invention, the fuel connector, the stationary core and the intermediate pipe are made of composite magnetic material. The fuel connector is magnetized and the intermediate pipe is non-magnetised to magnetically insulate the fuel connector from the valve body.

According to another feature of the present invention, a method of manufacturing the fuel injection valve comprises a step of fixing the needle valve to the movable core, inserting the movable core with the needle valve into the inside the single pipe member, inserting subsequently the stationary core into the inside of the single pipe member; and fixing the solenoid on an outer periphery of the single pipe member.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

First Embodiment

Figure 1:
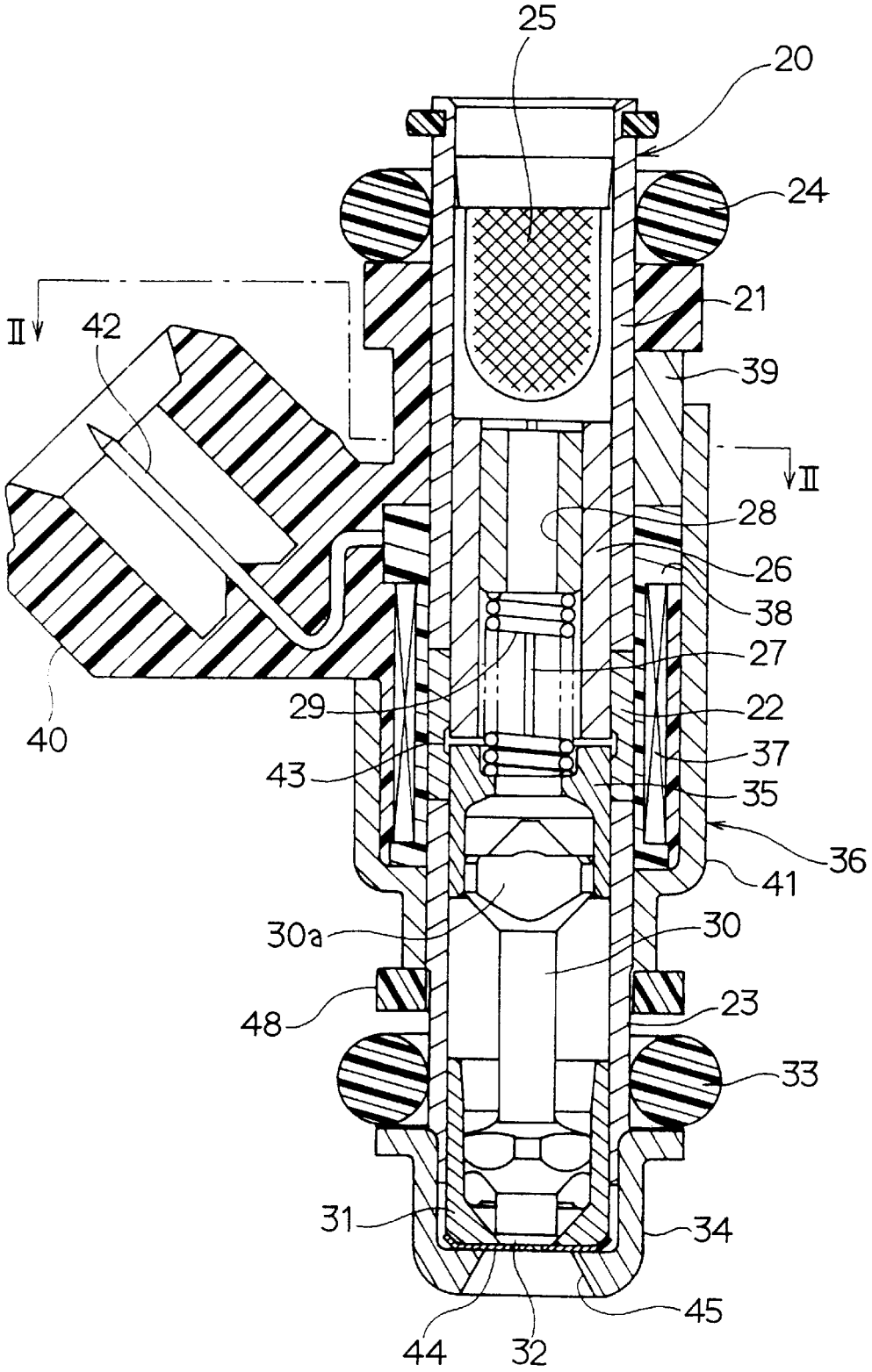
FIG. 1 is a cross-sectional view illustrating a fuel injection valve according to a first embodiment of the present invention.
Figure 2:
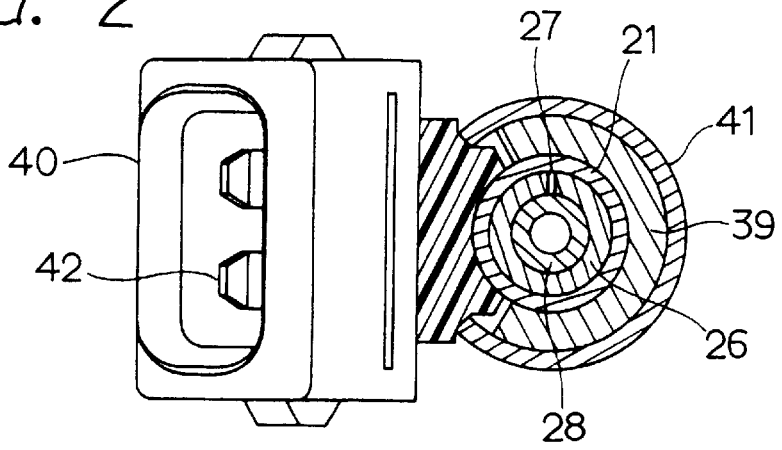
FIG. 2 is a cross-sectional view of the valve illustrated in FIG. 1 cut along a line II—II.

A fuel injection valve according to a first embodiment is described with reference to FIGS. 1 and 2.

The fuel injection valve has a single pipe member 20 made of a composite magnetic material, as disclosed in European Patent Publication 0629 711 A1. The pipe member 20 made of such composite magnetic material is processed to form a martensitic structure beforehand and subsequently processed to form an austenitic structure at the middle of the pipe member 20 so that the pipe member 20 provides a non-magnetic intermediate pipe portion 22 at the middle thereof which has the austenitic structure, and a magnetic fuel connector portion 21 and a magnetic valve body portion 23 at opposite sides of the intermediate pipe portion 22, both of which have the martensitic strcture. The portion having the martensitic structure provides the ferro-magnetic character, and the portions having the austenitic structure has the non-magnetic character.

Besides the single pipe member 20, the fuel injection valve has an O-ring 24 made of resinous material fitted around an upper portion of the connector portion 21, a fuel filter 25 disposed inside the connector portion 21, a cylindrical stationary core 26 made of common magnetic material is press-fitted to the inner periphery of the intermediate pipe portion 22 under the fuel filter 25. The cylindrical stationary core 26 has a longitudinal gap or slit 27 so that the stationary core 26 can contract when it is inserted into the intermediate pipe portion 22 and expand thereafter. The stationary core 26 extends axially to provide a surface sufficient to receive magnetic flux from the connector portion.

The single pipe member 20 is processed to form a magnetic fuel connector portion 21, a non-magnetic intermediate pipe portion 22 and a magnetic valve body portion 23.

A cylindrical adjuster 28 and a coil spring 29 are disposed axially inside the stationary core 26 and held therein by deforming an upper peripheral portion of the fuel connector, thereby providing a fuel passage inside the adjuster 28 and the coil spring 29. A needle valve 30 is slidably disposed in the valve body portion 23, and a valve seat 31 is fixed to the bottom of the valve body portion 23. The valve seat 31 has a nozzle hole 32, and the bottom end of the needle valve 30 opens or closes the nozzle hole 32.

An O-ring 33 and a stopper ring 48 are respectively disposed on the outer periphery of the valve body portion 23 to seal a portion connecting to an air intake manifold, and a sleeve 34 is fixed thereto under the O-ring 33 to cover the valve seat. The sleeve 34 and the valve seat 31 are welded (e.g. by a laser beam welder) to opposite surfaces of the valve body portion 23.

A nozzle plate 44 is disposed between the under surface of the valve seat 31 and the upper surface of the sleeve 34. The nozzle plate 44 has one or more nozzle holes which is or are formed at a portion facing the nozzle hole 32 and open to the outside from an opening 45 of the sleeve 34.

A hollow movable core 35 is press-fitted to the upper portion of the needle valve 30 to be slidable on the inner periphery of the valve body portion 23. The upper portion of the movable core 35 is inserted into the inner periphery of the intermediate pipe portion 22 to be slidable thereon so that the upper surface of the movable core 35 faces the bottom surface of the stationary core 26. The movable core 35 is biased by the spring 29 downward.

An annular groove 43 is formed on the inner periphery of the intermediate pipe 22 between the stationary core 26 and the movable core 25 to facilitate smooth motion of the movable core 35. The lower surface of the stationary core 26 and the upper surface of the movable core 35 are chrome-plated to form nonmagnetic hard coating thereon thereby forming a solid magnetic gap. The upper portion of the needle valve 30 has a pair of flat side surfaces 30*a* so that the fuel can pass through the spaces between the movable core 35 and the surface 30*a* toward the valve body portion 23.

A solenoid 36 is fixed on the outer periphery of the pipe member 20. The solenoid 36 is composed of an electromagnetic coil 37, a spool 38 made of resinous material, a yoke 39, a connector 40 and a housing 41 made of magnetic material. The connector 40 has a terminal pin 42 insert-molded therein. The solenoid 36 is disposed so that the electromagnetic coil 37 is positioned around the intermediate pipe portion 22. Then, the yoke 39 is inserted between the fuel connector 21 and the housing 41, and the bottom portion of the housing 41 is welded by a spot welder to the outer periphery of the valve body portion 23.

In the fuel injection valve described above, when the electromagnetic coil 37 is not energized, the movable core 35 is biased by the spring 29 downward, and the bottom portion of the needle valve 30 closes the nozzle hole 32 of the valve seat 31.

When the electromagnetic coil 37 is energized, magnetic flux is generated, and a magnetic circuit is formed. The magnetic circuit is composed of the housing 41, the yoke 39, the fuel connector 21, the stationary core 26, the movable core 35, the valve body portion 23, and the housing 41. In forming the above circuit, the intermediate pipe portion 22 prevents the magnetic flux from passing therethrough because the intermediate pipe portion 22 is processed to have the austenitic structure which provides nonmagnetic character.

When magnetic flux passes the magnetic circuit, the movable core 35 is driven upward, and the needle valve 30 is unseated from the valve seat 31 to open the nozzle hole 32. Thus, the fuel in the valve body portion 23 is injected through the nozzle holes of the nozzle plate 44.

Since the fuel connector portion 21, the intermediate pipe portion 22 and the valve body portion 23 are formed integrally in the single pipe member 20, no member or no step to connect them is necessary. Also, the fuel is prevented from flowing into the electromagnetic coil 37 without any additional member. The stationary core 26 can be formed in the fuel connector portion 21.

Second Embodiment

Figure 3:
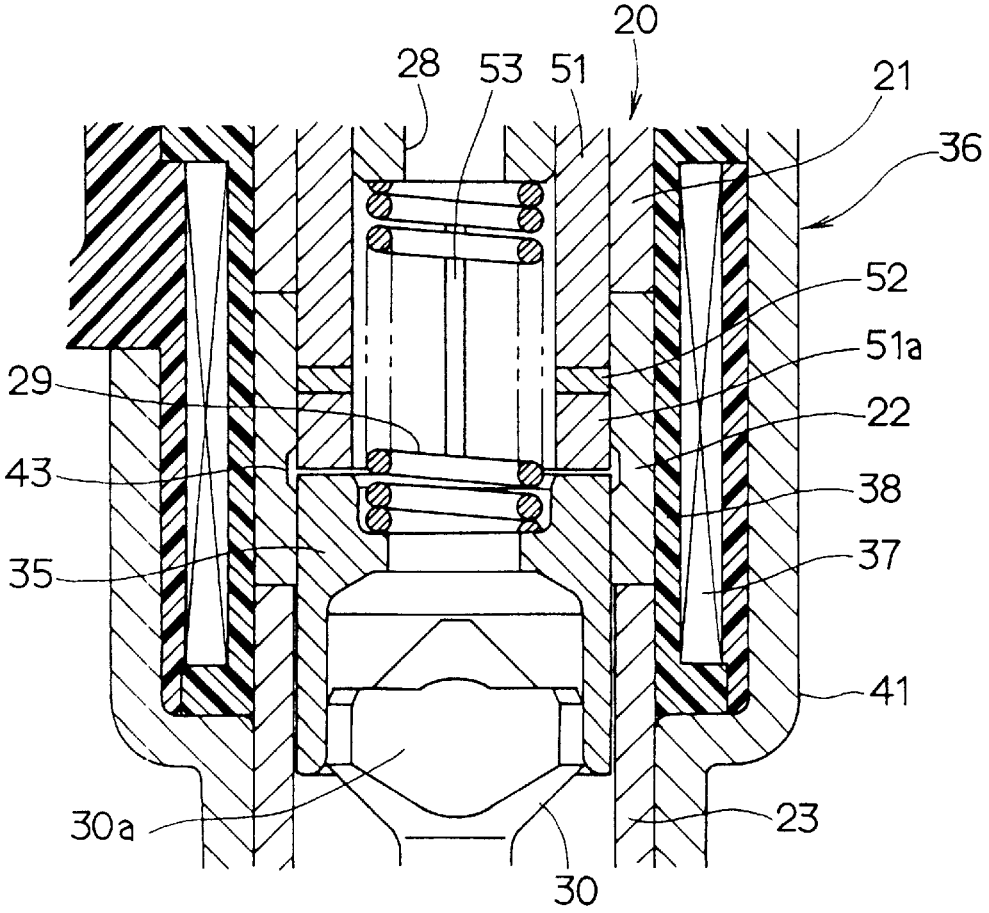
FIG. 3 is an enlarged cross-sectional view illustrating a portion of a fuel injection valve according to a second embodiment of the present invention.

A fuel injection valve according to a second embodiment of the present invention is described with reference to FIG. 3. A cylindrical stationary core 51, which has a longitudinal slit 53, is made of the composite magnetic material. The stationary core 51 is processed to form the martensitic structure beforehand, and a solid gap 52 is subsequently processed to form the austenitic structure. The solid gap 52 can be substituted for the chrome-plated coating described before. The width, position and/or shape of the solid gap 52 is easily changed so that the movable core 35 can smoothly separate from the stationary core 26 when the needle valve 30 closes the nozzle 32. The stationary core 51 facing the movable core 35 is automatically hardened as it is processed to form martensitic structure. Therefore, the wear of the stationary core 26 is prevented without a specific member or process. The movable core 35 can be made of the composite magnetic material also. In this case, the solid gap is formed on the surface facing the stationary core 26.

Third Embodiment

Figure 4:
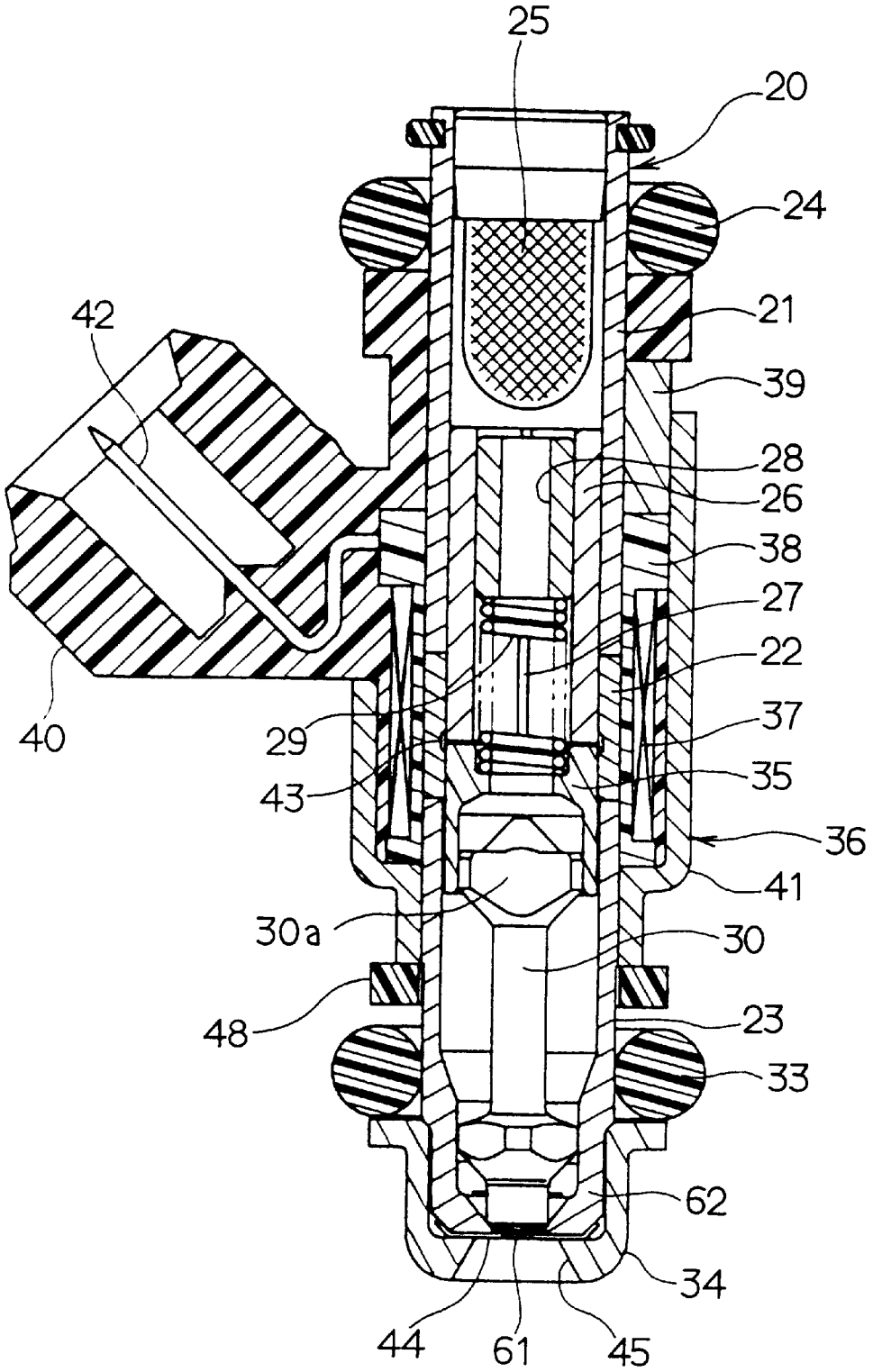
FIG. 4 is a cross-sectional view illustrating a fuel injection valve according to a third embodiment of the present invention.

A fuel injection valve according to a third embodiment of the present invention is described with reference to FIG. 4. A valve seat portion 62 having a nozzle hole 61 is formed in the pipe member 20 together with the valve body 23, the fuel connector portion 21 and the intermediate pipe portion 22. Other structures are substantially the same as the first embodiment. The valve seat portion 62 has the martensitic structure, which has a high wear resistance.

Fourth Embodiment

Figure 5:
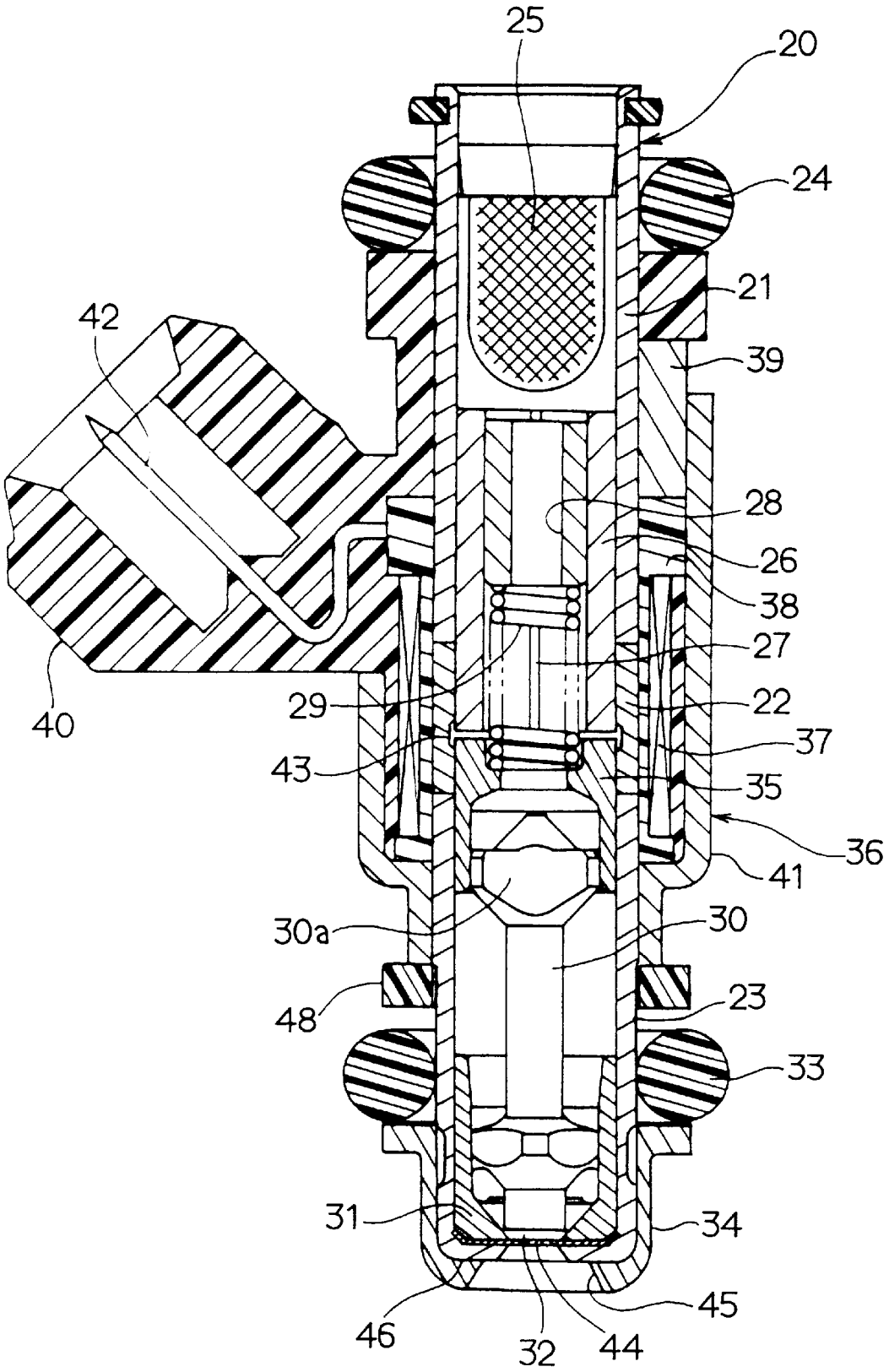
FIG. 5 is a cross-sectional view illustrating a fuel injection valve according to a fourth embodiment of the present invention.

A fuel injection valve according to a fourth embodiment is described with reference to FIGS. 5–7.

An annular valve seat support portion 46 is formed in the pipe member 20 together with the fuel connector portion 21, intermediate pipe portion 22 and the valve body portion 23. The valve support portion 46 is formed under the valve body portion 23 receives the valve seat 31 when it is inserted from above. Other portions are substantially the same as the first embodiment.

Figure 6:
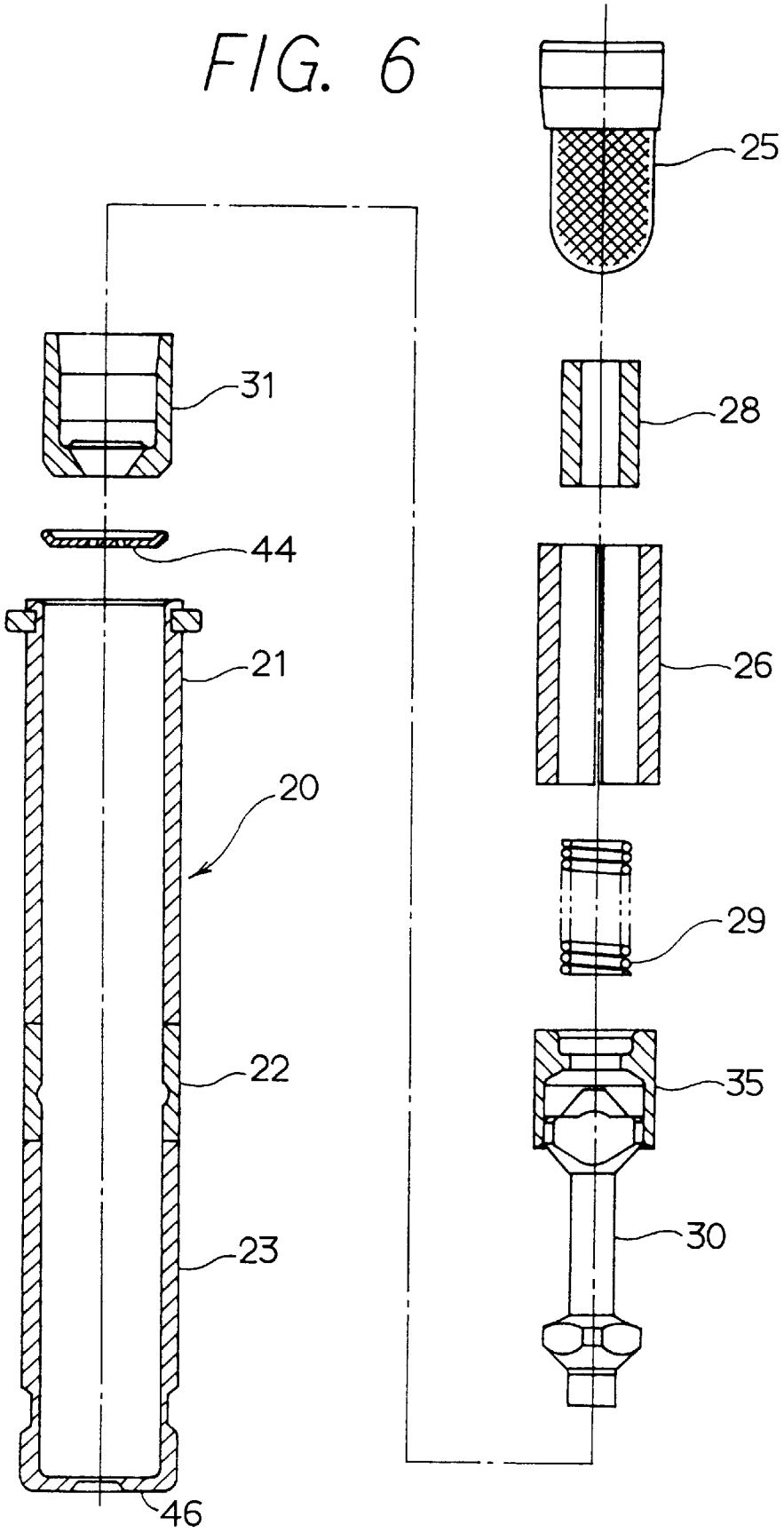
FIG. 6 is an exploded view illustrating a pipe and parts thereof assembled thereto.

Since the inner diameter of the fuel connector portion 21, the intermediate pipe portion 22 and the valve body portion 23 is the same, the nozzle plate 44, the valve seat 31, the needle valve 30 with the movable core 35, the spring 29, the stationary core 26, the adjuster 28 and the net filter 25 can be inserted simply into the single pipe member 20 one after another, as shown in FIG. 6. The movable core 35 and the needle valve 30 are fixed beforehand by welding or the like.

Figure 7:
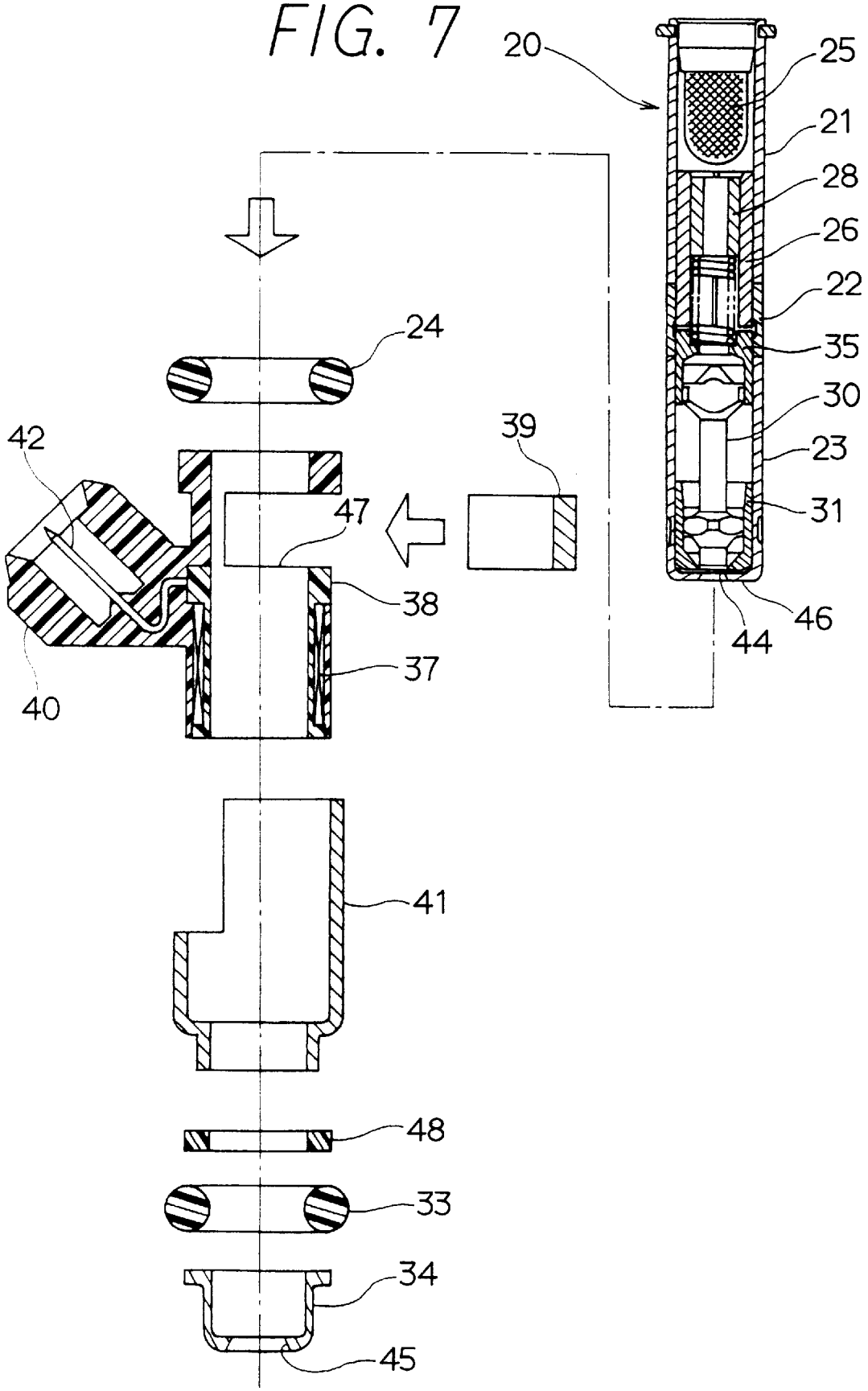
FIG. 7 is an exploded view illustrating the pipe and parts assembled thereto.

As shown in FIG. 7, the electromagnetic coil 37 and the connector 40 are molded in a unit, and the yoke 39 is fitted in a concave 47. This semi-assembly is inserted into the housing 41 from above to form the solenoid 36, and the assembly of the pipe member 20 with the various parts therein is inserted into the inside of the solenoid 36 from above. Thereafter, the bottom of the housing 41 and the bottom of the valve body portion 23 are welded together, and the stopper ring 48, the O-ring 33, the sleeve 34 are fitted on the outer periphery of the valve body portion 23. Finally, the O-ring 24 is fitted on the outer periphery of the fuel connector 21.

Fifth Embodiment

Figure 8:
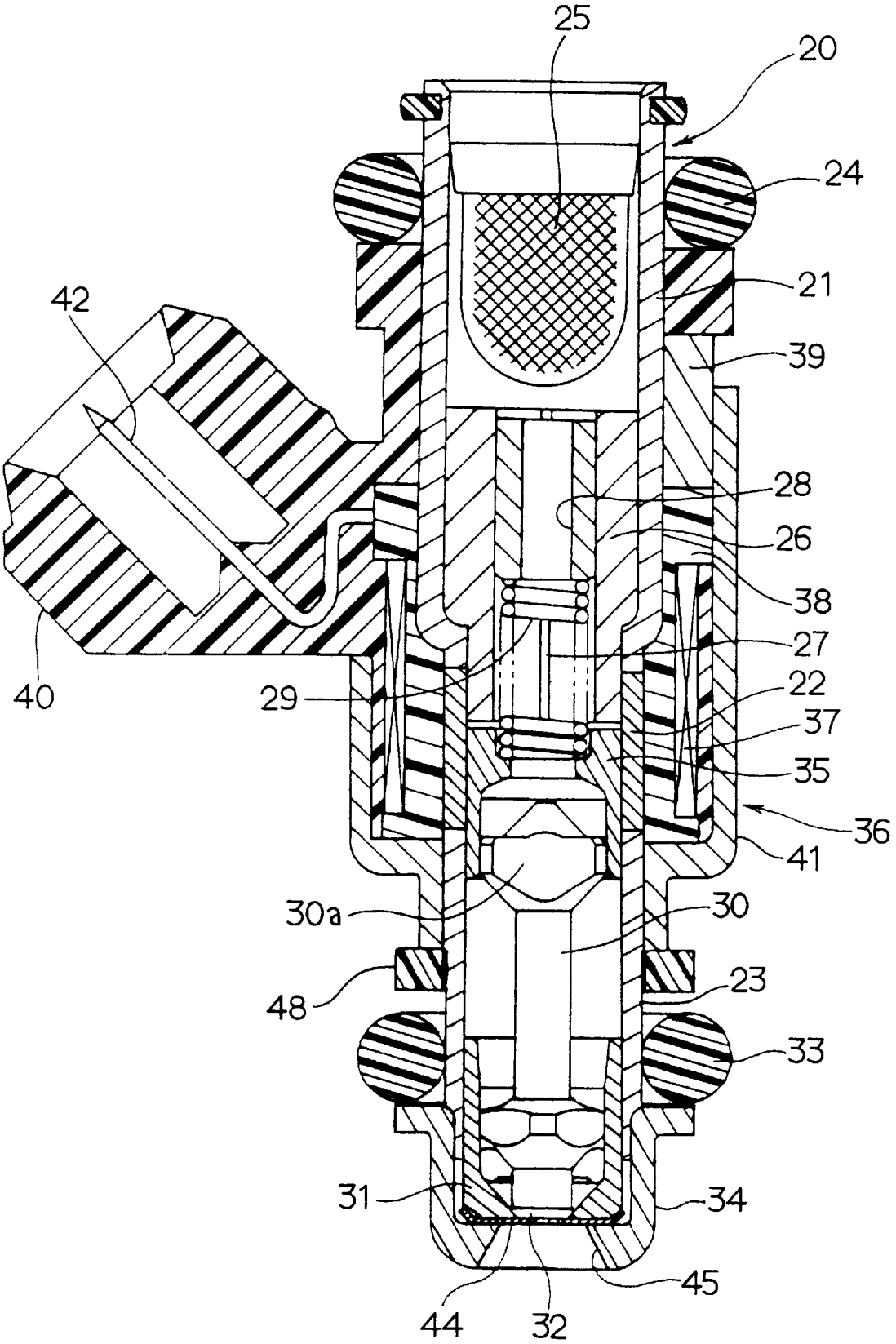
FIG. 8 is a cross-sectional view illustrating a fuel injection valve according to a fifth embodiment of the present invention.

A fuel injection valve according to a fifth embodiment of the present invention is described with reference to FIG. 8. The inner diameter of the fuel connector portion 21 is larger than the inner diameter of the valve body portion 23, and the inner diameter of the intermediate pipe portion 22 is equal to the inner diameter of the valve body portion 23. The outer periphery of the stationary core 26 is shaped to fit the inner periphery of the fuel connector portion 21.

Sixth Embodiment

Figure 9:
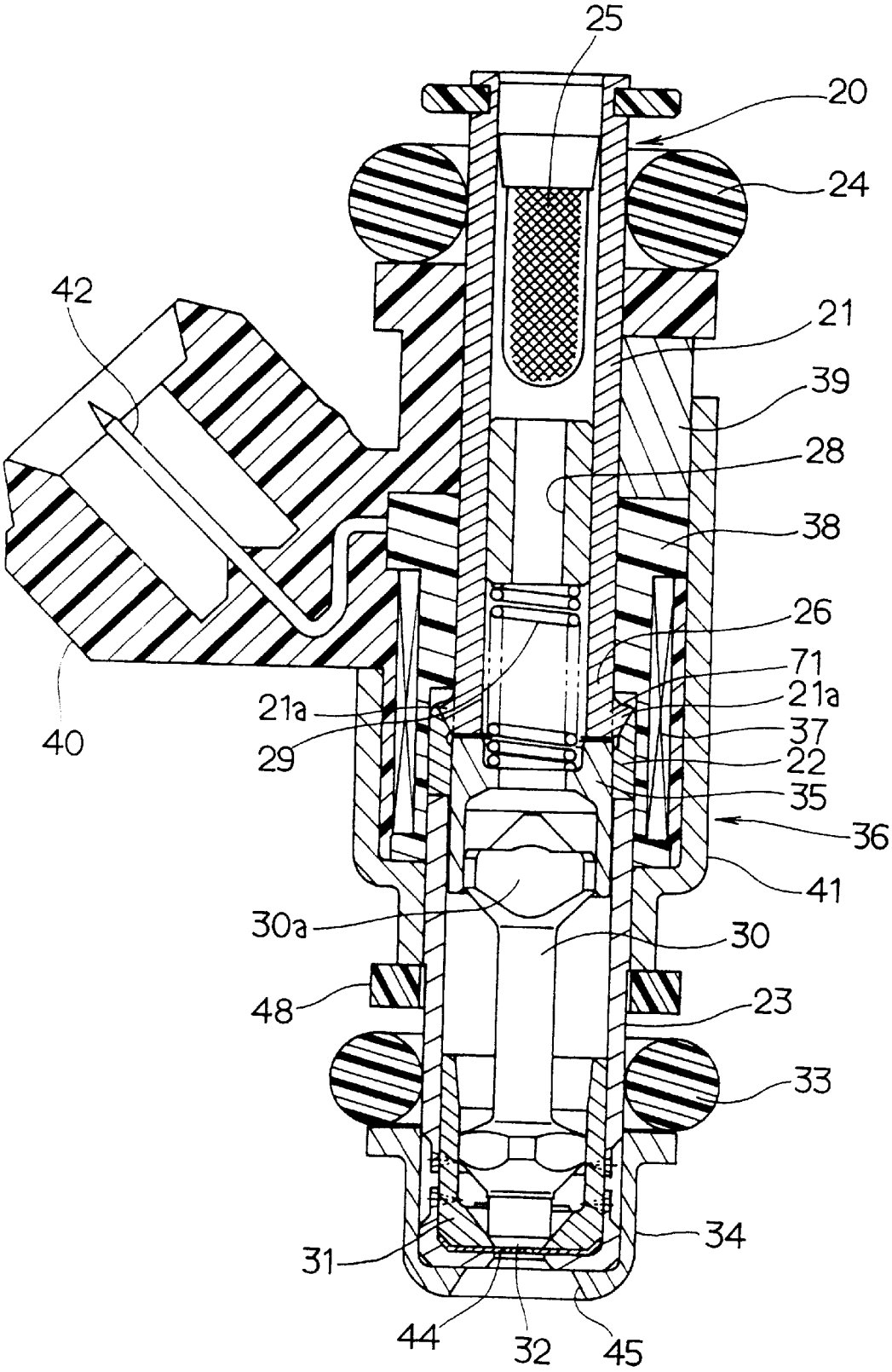
FIG. 9 is a cross-sectional view illustrating a fuel injection valve according to a sixth embodiment of the present invention.

A fuel injection valve according to a sixth embodiment is described with reference to FIG. 9.

The inner diameter of the fuel connector portion 21 is smaller than the inner diameter of the intermediate pipe portion 22, which is equal to the inner diameter of the valve body portion 23. The fuel connector portion 21 has a flange portion 21*a* extending outward to be in contact with the upper surface of the intermediate pipe portion 22 having the austenitic structure, so that the bottom surface of the fuel connector can be in contact with the upper surface of the movable core 35. The flange portion 21*a* is processed to have the austenitic structure while remainder of the fuel connector portion 21 has the martensitic structure.

Seventh Embodiment

Figure 10:
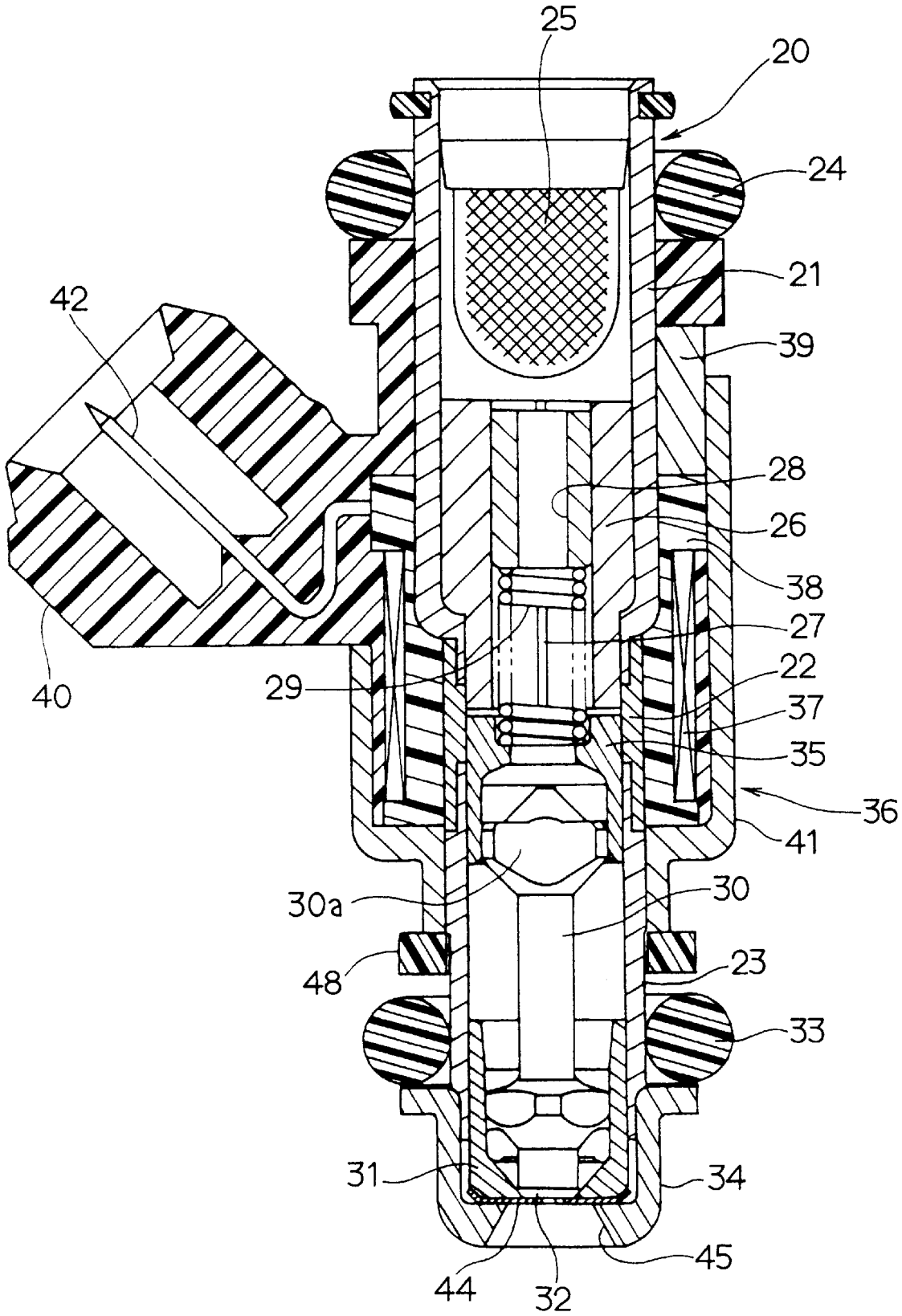
FIG. 10 is a cross-sectional view illustrating a fuel injection valve according to a seventh embodiment of the present invention.

A fuel injection valve according to a seventh embodiment of the present invention is described with reference to FIG. 10. The magnetic fuel connector portion 21, the nonmagnetic intermediate pipe portion 22, and the magnetic valve body portion 23 are made of separate members and welded together. In this embodiment, the inner diameter of the fuel connector portion and the intermediate pipe portion is formed equal to or larger than the inner diameter of the valve body portion. Other portions are the same as one of the above-described embodiments.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel injection valve having a magnetic fuel connector, and a magnetic valve body, a nonmagnetic intermediate pipe connected between said fuel connector and said valve body, an electromagnetic solenoid disposed around said intermediate pipe, a needle valve disposed in said valve body, a magnetic stationary core disposed inside said fuel connector and a magnetic movable core disposed inside said valve body in a magnetic circuit composed of said solenoid, said fuel connector, said stationary core and said valve body, wherein said fuel connector, said intermediate pipe and said valve body are formed integrally in a unitary member made of composite magnetic material;

said fuel connector and said valve body are ferro-magnetized to form a magnetic circuit between said stationary core and said movable core, and said intermediate pipe is non-magnetized to magnetically insulate said fuel connector from said valve body, wherein:

said stationary core comprises a member made of magnetic composite material having a ferro-magnetized structure and a non-magnetized structure disposed to divide said ferro-magnetized structure to provide a solid gap.

2. A fuel injection valve comprising:

a unitary pipe made of a composite magnetic material including a ferromagnetic fuel connector portion disposed at one end thereof, a ferromagnetic valve body portion disposed at the other end thereof and non-magnetic intermediate pipe portion disposed between said fuel connector portion and said valve body portion;

an electromagnetic solenoid disposed outside said unitary pipe around said intermediate pipe portion;

a needle valve disposed inside said unitary pipe at said valve body portion;

a magnetic stationary core disposed inside said unitary pipe at a portion of said intermediate pipe portion and also extending along al least a portion of said fuel connector portion to provide a surface receiving magnetic flux from said fuel connection portion; and a magnetic movable core disposed inside said unitary pipe to face an axial end of said stationary core through a magnetic gap and fixed to said needle valve to form a magnetic circuit for said solenoid together with said fuel connector portion, said stationary core and said valve body, and to be slidable on the inner periphery of said valve body portion.

3. A fuel injection valve as in claim 2 wherein said stationary core is press-fitted to said fuel connector.

4. A fuel injection valve as in claim 3 wherein:

said stationary core comprises a cylindrical member having a longitudinal slit.

5. A fuel injection valve as in claim 2 wherein:

said valve body comprises an integral valve seat having ferro-magnetized structure.

6. A fuel injection valve as in claim 2 wherein:

said fuel connector has an inner diameter which is equal to or larger than an inner diameter of said intermediate pipe.

7. A fuel injection valve as in claim 2 further comprising:

a pair of O-rings for sealing spaces formed when said valve is installed into an engine, and wherein said solenoid is disposed between said O-rings.

8. A fuel injection valve as in claim 2 wherein said axial end of said stationary core and the surface of said movable core facing said axial end are chrome-plated to form a solid magnetic gap.

9. A fuel injection valve as in claim 2 wherein said axial end of said stationary core is disposed at about a middle of said intermediate pipe.

10. A fuel injection valve comprising:

a unitary pipe composed of a magnetic fuel connector portion at one end thereof, a magnetic valve body portion at the other end thereof, and a non-magnetic intermediate pipe portion between said fuel connector portion and said valve body portion;

an electromagnetic solenoid disposed outside said unitary pipe around said intermediate pipe;

a magnetic stationary core disposed inside said unitary pipe to extend axially to provide a surface sufficient to receive magnetic flux from said fuel connector portion;

a magnetic movable core disposed to be magnetically spaced apart from said stationary core inside said unitary pipe to form a magnetic circuit for said solenoid together with said fuel connector portion, said stationary core and said valve body portion, wherein said unitary pipe is made of material that can be changed from magnetic material to non-magnetic material.

11. A fuel injection valve comprising:

a generally straight and smooth unitary pipe composed of a martensitic fuel connector portion at one end thereof, a martensitic valve body portion at the other end thereof, and an austenitic intermediate pipe portion between said fuel connector portion and said valve body portion;

an electromagnetic solenoid disposed outside said unitary pipe around said intermediate pipe;

a magnetic stationary core disposed inside said unitary pipe to extend axially to provide a surface sufficient to receive magnetic flux from said fuel connector portion;

a magnetic movable core disposed inside said unitary pipe to form a magnetic circuit for said solenoid together with said fuel connector portion, said stationary core and said valve body portion.

12. A fuel injection valve comprising:

a unitary pipe made of a composite material capable of being selectively made to have ferromagnetic properties or not to have ferromagnetic properties;

said pipe having an intermediate portion not having ferromagnetic properties located between first and second portions having ferromagnetic properties;

an electromagnetic solenoid disposed outside said unitary pipe at said intermediate portion and extending along at least part of said first and second portions;

a needle valve disposed inside said unitary pipe at said second portion;

a stationary ferro-magnetic core disposed inside said unitary pipe at said intermediate portion and extending along a part of said first portion to provide a surface receiving magnetic flux from said first portion; and a movable ferromagnetic core disposed inside said unitary pipe to face an axial end of said stationary core through a magnetic gap and fixed to said needle valve to form a magnetic circuit for said solenoid together with said first portion, said second portion, and said stationary core while being slidable on an inner periphery of said second portion.

* * * * *